US007220136B1

(12) United States Patent
Green

(10) Patent No.: US 7,220,136 B1
(45) Date of Patent: May 22, 2007

(54) COMPACT ELECTRIC PLUG AND SOCKET COMBINATIONS

(76) Inventor: Robert L. Green, 2332 Pine Hollow Trail, Brighton, MI (US) 48114-4900

( * ) Notice: Subject to any disclaimer, the term of this patent is extended or adjusted under 35 U.S.C. 154(b) by 0 days.

(21) Appl. No.: 11/251,741

(22) Filed: Oct. 15, 2005

Related U.S. Application Data

(60) Provisional application No. 60/618,652, filed on Oct. 14, 2004.

(51) Int. Cl.
*H01R 5/04* (2006.01)

(52) U.S. Cl. ..... 439/106; 439/651

(58) Field of Classification Search ..... 439/106–107, 439/92, 651, 652, 105
See application file for complete search history.

(56) References Cited

U.S. PATENT DOCUMENTS 2,676,223 A * 4/1954 Whitaker ..... 337/197
3,061,716 A * 10/1962 Benander ..... 362/641
4,293,172 A * 10/1981 Lingaraju ..... 439/105
4,575,704 A * 3/1986 Pezold ..... 337/197
4,634,211 A * 1/1987 Poliak et al. ..... 439/106
4,767,359 A * 8/1988 Martell ..... 439/535
D324,029 S * 2/1992 Luu ..... D13/137
5,094,630 A * 3/1992 Jammet ..... 439/652
5,171,168 A * 12/1992 Chiodo ..... 439/651
5,211,584 A * 5/1993 Lee ..... 439/652
5,466,165 A * 11/1995 Boesel et al. ..... 439/142
D450,036 S * 11/2001 Okamoto ..... D13/137.2
7,004,595 B1 * 2/2006 Stoddard ..... 362/95

* cited by examiner

*Primary Examiner*—Michael C. Zarroli
(74) *Attorney, Agent, or Firm*—James M. Deimen

(57) ABSTRACT

A plug and socket combination positions a plug and electrical cord at an orientation perpendicular to a wall socket, thus reducing the required clearance to substantially that of the plug width without the electrical cord or less than half of the clearance normally required. Two-pronged and three-pronged plug and socket combinations have been developed that are substantially the same width, length, and depth as the typical plug on a two or three wire electrical cord.

5 Claims, 4 Drawing Sheets

COMPACT ELECTRIC PLUG AND SOCKET COMBINATIONS

This application claims the benefit of provisional patent application No. 60/618,652, filed Oct. 14, 2004.

BACKGROUND OF THE INVENTION

The field of the invention pertains to common household plugs and sockets in use in North America and, in particular, to plug and socket combinations for use in very restricted areas.

A wide variety of plug and socket combinations have been created for expanding the number of sockets from the one or two sockets available in a typical wall outlet. Wall outlet sockets require two or more inches of clearance for typical plugs and associated wires to avoid pinching the wires and causing a possible fire hazard. Plug and socket combinations for expanding the number of available sockets increase the clearance required to three or more inches. Where space is at a premium and furniture or appliances should be as close to the wall sockets as possible, a more compact plug and socket is needed to reduce the clearance required. This problem also occurs where sockets are mounted in mantelpieces, or just above mantelpieces. In such locations, plugs and sockets should be discretely hidden.

SUMMARY OF THE INVENTION

With a view to reducing the clearance as much as possible, two-pronged and three-pronged plug and socket combinations have been developed that are substantially the same width, length, and depth as, or less than, the typical plug on a two or three wire electrical cord. The new plug and socket combination positions the plug and electrical cord at an orientation perpendicular to the wall socket, thus reducing the required clearance to substantially that of the plug width without the electrical cord or less than one and one-half inches for grounded plugs and about one-half inch for ungrounded plugs.

DESCRIPTION OF THE PREFERRED EMBODIMENTS

Figure 1:
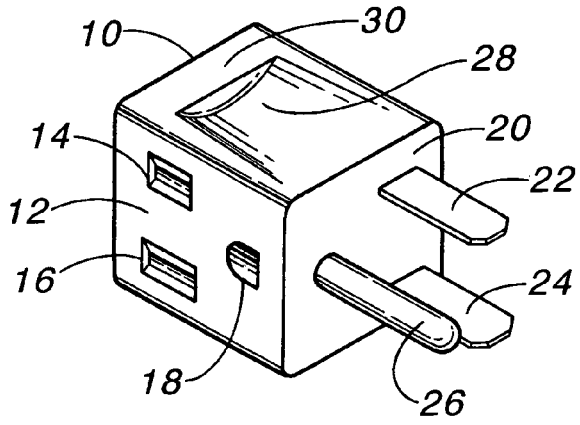
FIG. 1 is a perspective view of a three-prong right angle plug and socket combination.
Figure 2:
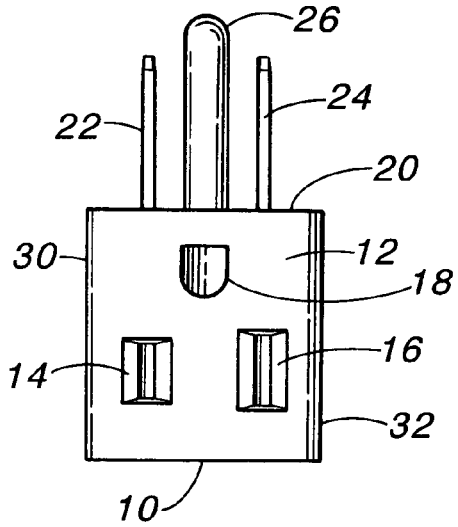
FIG. 2 is a socket side view of the plug and socket.

Illustrated in FIG. 1 and FIG. 2 is a body of cube or parallelepiped shape having six faces. The first face 12 has socket holes 14 and 16 for polarized prongs and a third socket hole 18 for a ground prong in a conventional arrangement. A second face 20 is perpendicular to the first face 12 and has polarized prongs 22 and 24 and ground prong 26 extending therefrom. This plug and socket combination permits a very simple internal electrical configuration. Specifically hole 14 and prong 22 lie in substantially the same plane, hole 16 and prong 24 both lie in a second plane and hole 18 and prong 26 both lie in a third plane, the planes being parallel to each other. Thus, each electrical connection need only lie in a single plane. A dimple 28 is formed in a third face 30 and optionally a second dimple may be formed in a fourth face 32 opposite the third face to assist in easily removing the plug and socket combination from a wall socket.

Figure 3:
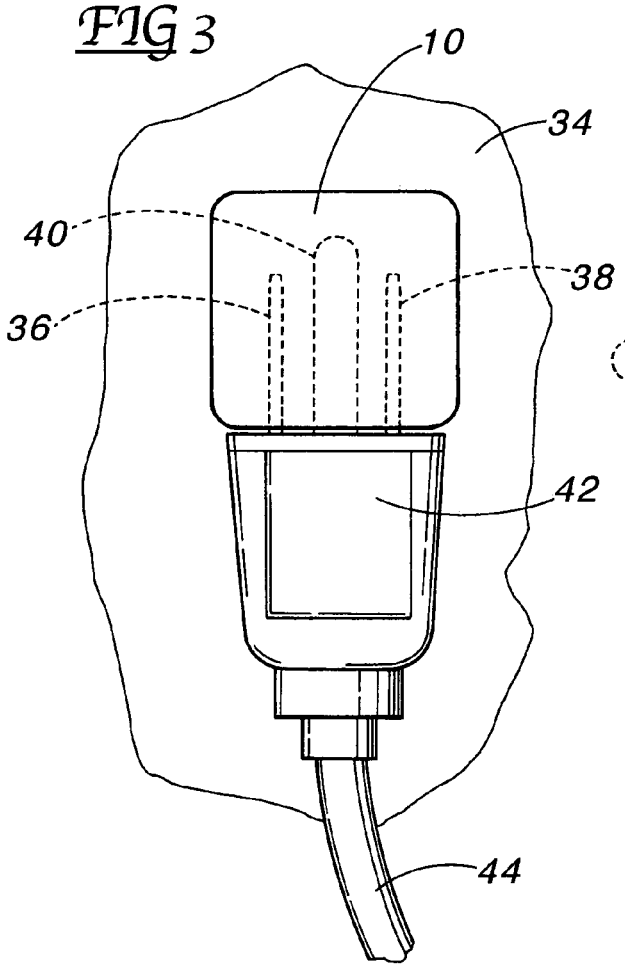
FIG. 3 is a wall face view of the plug and socket combination with a plug and cord attached.
Figure 4:
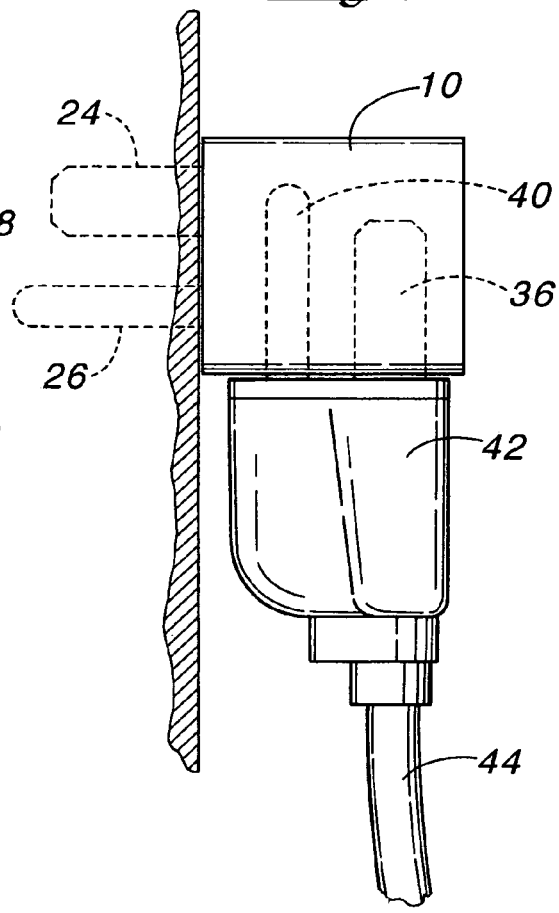
FIG. 4 is a side view of the plug and socket combination with a plug and cord attached.

The plug and socket combination of FIGS. 1 and 2 is shown in use in FIGS. 3 and 4. The wall 34 includes a conventional wall socket into which the three prongs 22, 24, and 26 are inserted to bring the body 10 close to the wall. In turn the three prongs 36, 38, and 40 of a conventional plug 42 and electrical cord 44 are inserted into the socket holes 14, 16, and 18 from below, thus keeping the conventional plug and cord within the clearance required by the body 10. This clearance is normally less than one and one-half inches.

Figure 5:
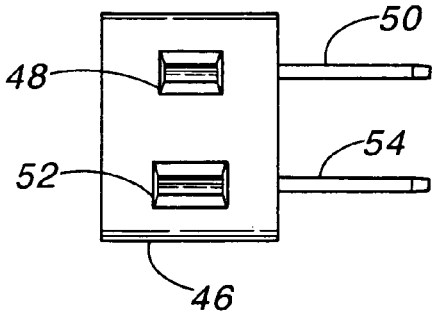
FIG. 5 is a side view of a two-prong polarized plug and socket combination.
Figure 6:
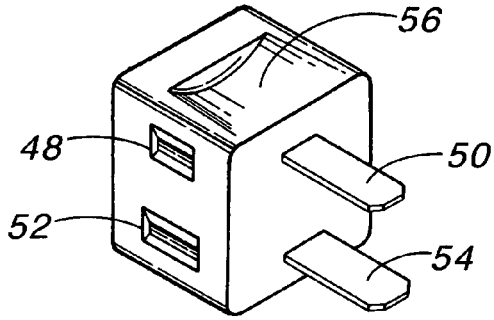
FIG. 6 is a perspective view of a the two-prong polarized plug and socket combination.

Illustrated in FIGS. 5 and 6 is a body 46 of parallelepiped shape for a two wire ungrounded polarized household electrical system. Although generally no longer approved in new construction or remodeling, two wire systems remain in common use. As shown above the smaller socket hole 48 and smaller prong 50 lie in substantially the same plane and the larger socket hole 52 and larger prong 54 lie in a parallel plane, thus simplifying the electrical connections within the combined plug and socket. As shown above the body 46 includes at least one dimple 56 for ease of removal from a wall outlet. The thickness of the two-prong plug and socket combination can be about one-half inch thick to match two-prong plugs of similar thickness.

Figure 7:
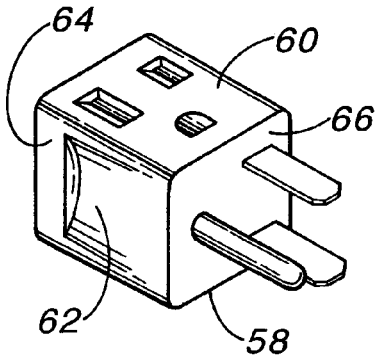
FIG. 7 is a perspective of an alternate form of three-prong right angle plug and socket combination.
Figure 8:
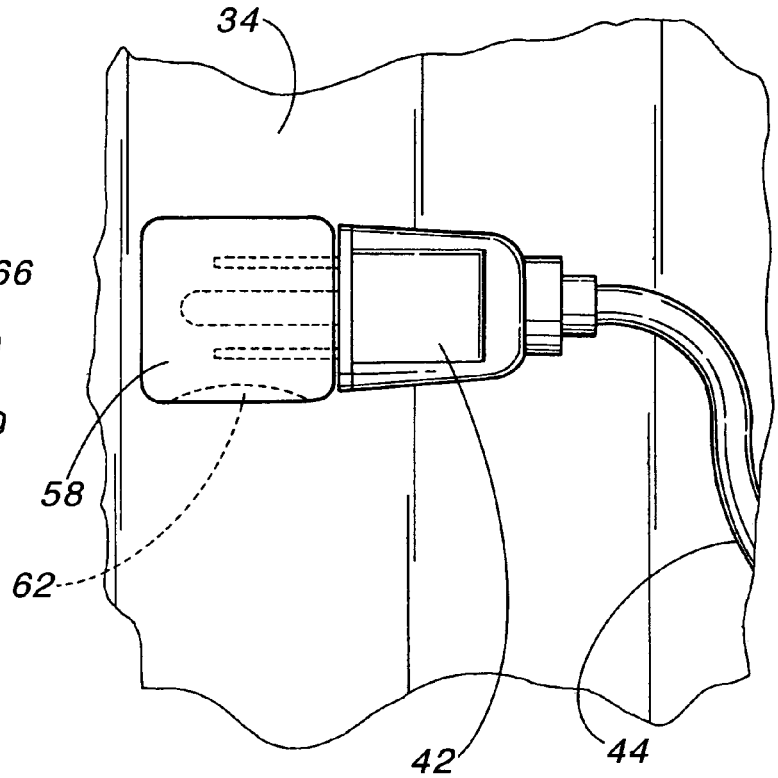
FIG. 8 is a wall face view of the plug and socket combination of FIG. 7 with a plug and cord attached.

In FIG. 7 as shown the body 58 has the socket face 60 and dimple 62 face 64 reversed in orientation relative to the prong face 66 in comparison with FIG. 1. This configuration positions the socket face 60 to the side permitting a plug 42 and cord 44 to be oriented to the side at a wall socket and wall 24 as shown in FIG. 8. Unfortunately, this orientation does not permit all of the electrical connections between the prongs and their respective socket holes to lie in the same planes thus requiring more complicated electrical connections within the plug and socket combination.

Figure 9:
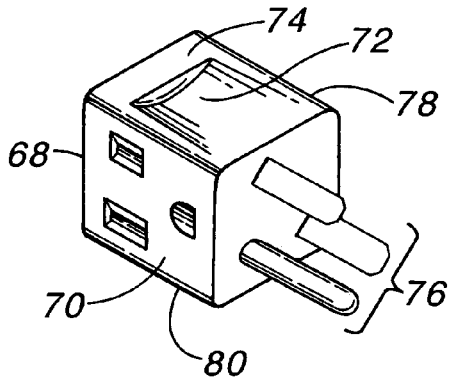
FIG. 9 is a perspective view of a three-prong plug and socket combination with the three prongs oriented at 45° from the combinations in FIGS. 1 and 7.
Figure 10:
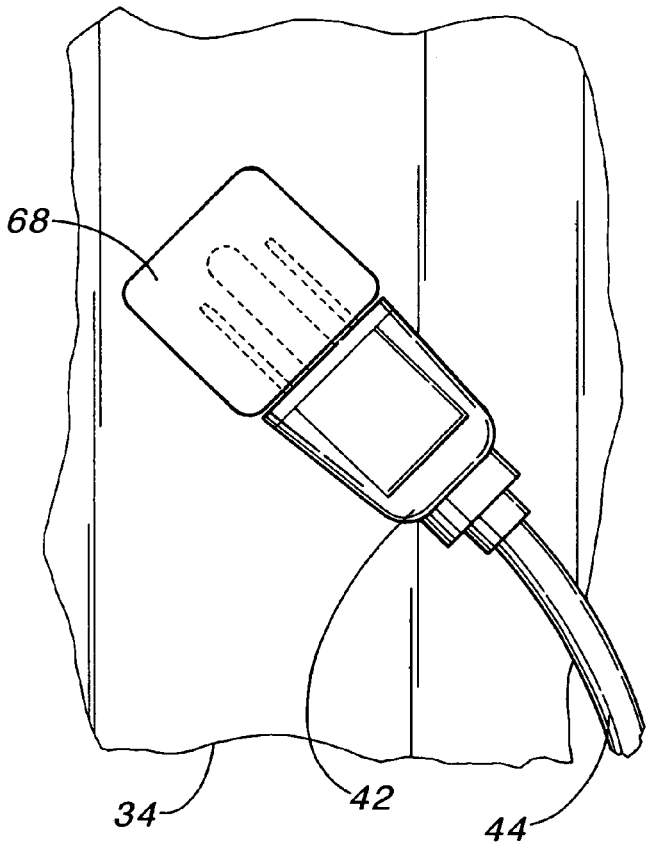
FIG. 10 is a wall face view of the plug and socket combination of FIG. 9 with a plug and cord attached.

Illustrated in FIG. 9 the body 68 has the socket face 70 and dimpled 72 face 74 in the same orientation as in FIG. 1 however, the three prongs 76 are symmetrically located about a diagonal plane including edges 78 and 80 of the body. This diagonal orientation permits the plug and socket combination to be plugged into a wall 34 socket at a 45° angle as shown in FIG. 10. With the body 68 at a 45° angle the plug 42 and cord 44 extend from the body at a 45° angle which is particularly advantageous where the cord will extend along a floor adjacent to the floor molding.

Illustrated in FIGS. 11 through 14 are plug and dual socket combinations where the sockets are above and below or to either side of the plug portion. In addition, to the exterior of each plug and dual socket combination the interior configuration of the electrical conductors are shown.

Figure 11:
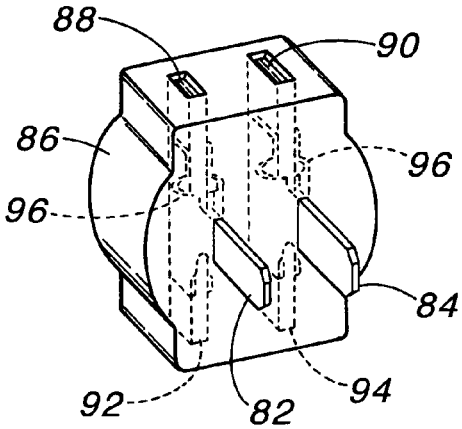
FIG. 11 is a perspective view of an ungrounded two-prong plug with sockets above and below.

In FIG. 11, two prongs 82 and 84 are shown extending from the body 86. Above and below the prongs 82 and 84 are socket holes 88 and 90 (above) and 92 and 94 (below). The interior electrical connections 96, as well as the below socket holes 92 and 94, are shown in dashed outline.

Figure 12:
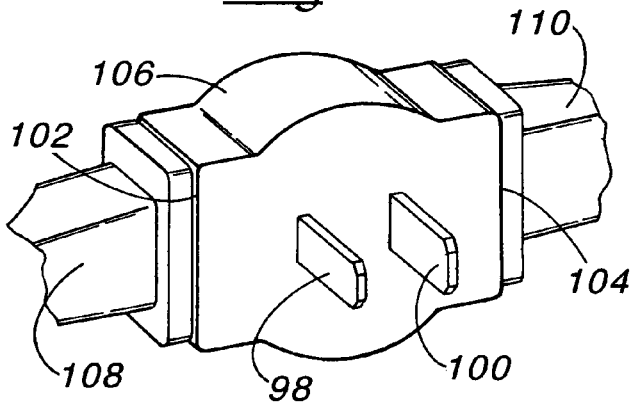
FIG. 12 is a perspective view of an ungrounded two-prong plug with sockets to each side.

In FIG. 12, the prongs 98 and 100 are oriented 90° from the prongs 82 and 84 in FIG. 11. Thus, the sockets 102 and 104 are oriented to either side of the body 106 with plugs 108 and 110 inserted therein.

Figure 13:
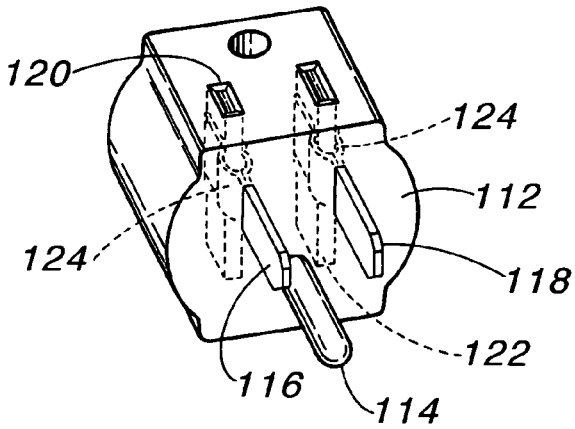
FIG. 13 is a perspective view of a grounded three-prong plug with sockets above and below.

Shown in FIG. 13 is a body 112 having a third ground prong 114 extending below the other prongs 116 and 118. Sockets 120 and 122 are oriented above and below the prongs 114, 116 and 118. As above, the interior electrical conductors 124 are shown in dashed outline.

Figure 14:
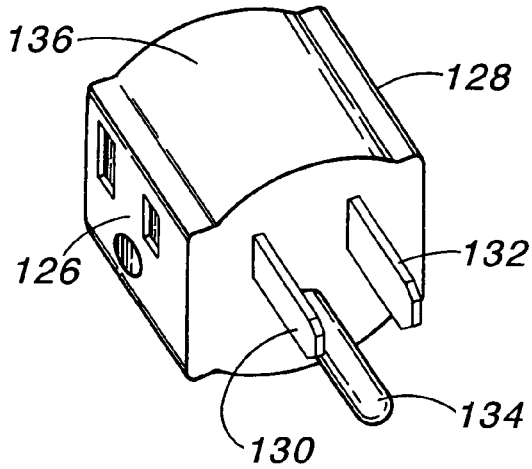
FIG. 14 is a perspective view of a grounded three-prong plug with sockets to each side.

Similarly, in FIG. 14, the sockets 126 and 128 are oriented side-to-side with respect to the prongs 130, 132 and 134 extending from the body 136.

The invention claimed is:

1. A plug and socket combination comprising a body, a plurality of faces on the body, a plurality of holes intersecting at least a first face on the body to form a socket, a set of no more than three prongs with at least two being ungrounded and extending from a second face on the body, said second face being substantially perpendicular to the first face and a third face on the body, said third face parallel to the second face and devoid of prongs or socket complementary to the first face socket or second face prongs, wherein each prong lies in the same plane as the corresponding electrically connected hole.

2. The plug and socket combination of claim 1 including a fourth face formed with means to assist in gripping the plug and socket combination.

3. A plug and socket combination comprising a body, a plurality of faces on the body, a plurality of holes intersecting at least a first face on the body to form a socket, a set of no more than three prongs with at least two being ungrounded and extending from a second face on the body, said second face being substantially perpendicular to the first face and a third face on the body, said third face parallel to the second face and devoid of prongs or socket complementary to the first face socket or second face prongs, and including a face on the body perpendicular to the second face and having a second socket.

4. The plug and socket combination of claim 3 wherein at least one prong lies in a plane not including the plane of the corresponding electrically connected hole.

5. The plug and socket combination of claim 3 including a fourth face formed with means to assist in gripping the plug and socket combination.

* * * * *